United States Patent [19]

Mamistov et al.

[11] 4,125,947

[45] Nov. 21, 1978

[54] DRIER FOR BULK MATERIAL

[76] Inventors: Vasily V. Mamistov, ulitsa Mayakovskogo, 13, kv. 50, Khimki Moskovskoi oblasti; Alexandr A. Koryagin, Severny bulvar, 17, kv. 64, Moscow; Vladimir P. Burov, ulitsa Garibaldi, 30, korpus, 3, kv. 47, Moscow; Vladimir F. Denisov, Pervy Likhachevsky pereulok, 2, kv. 45, Moscow; Vasily T. Balashov, ulitsa Taininskaya, 20, kv. 57, Moscow, all of U.S.S.R.

[21] Appl. No.: 803,119

[22] Filed: Jun. 2, 1977

[51] Int. Cl.[2] ..... F26B 11/02

[52] U.S. Cl. ..... 34/108; 34/124; 34/177

[58] Field of Search ..... 34/108, 119, 121, 124, 34/125, 165, 177

[56] References Cited

U.S. PATENT DOCUMENTS

| | | | |
|---|---|---|---|
| 308,529 | 11/1884 | Stollwerck | 34/108 |
| 2,558,206 | 6/1951 | Baird | 34/177 X |
| 3,772,799 | 11/1973 | Yoshikawa et al. | 34/108 X |

FOREIGN PATENT DOCUMENTS 1,593,256 7/1970 France.

*Primary Examiner*—Edgar W. Geoghegan
*Attorney, Agent, or Firm*—Haseltine, Lake & Waters

[57] ABSTRACT

The apparatus consists of a hollow cylindrical case arranged at an angle to the horizontal axis of its rotation. Disposed in a space inside the case are coils each bent into a helix of suitable shape, arranged coaxially relative to other coils and connected to manifolds which are attached to an internal wall of the case, each with only one of its ends and are connected to a space between the walls of the case passing wherethrough is a heat carrier. The points where the coils are connected to the manifolds are separated from the internal wall of the case by a distance anywhere between ⅓ and ½ of the internal diameter of the case of the drier.

2 Claims, 2 Drawing Figures

DRIER FOR BULK MATERIAL

BACKGROUND OF THE INVENTION

The present invention relates to driers for bulk material which can find utility in the chemical and food industries.

There is known a drier for bulk material fabricated by Krupp of the Federal Republic of Germany consisting of a hollow cylindrical case installed at an angle to the horizontal axis of its rotation and provided with double walls forming a space passed wherethrough is a heat carrier (steam) which is admitted through a passage in a trunnion while condensate is extracted through another passage in the same trunnion. A passage in the other trunnion of the case serves to evacuate the space inside the case.

Known driers require much metal for their manufacture, yet the rate of their throughput is low, an inadequate heating surface being the explanation. The amount of moisture evaporated therein per square meter of the heating surface is also low due to insufficient mixing of the processed material inside the drier and poor contact of the material with the heating surface.

French Pat. No. 1,593,256 discloses a drier for bulk material which is formed of a hollow cylindrical casing rotating about the horizontal axis and containing tubes which are located along the walls all the way along the circumference thereof and parallel to the longitudinal axis. Each of the tubes is welded at its ends to respective tube plates so that the space inside thereof is connected to the space between double walls of the casing a heat carrier passing therethrough. When the drier is in operation, the heat carrier, e.g., steam, is admitted into the space between the double walls of the drier casing through a passage in a trunnion and thence enters the tubes running lengthwise through the space inside the drier casing. The thermal stresses set up in the drier casing differ in magnitude from those subjected to which are the tubes and this difference triggers failures of welds at the joints between the tubes and drier casing.

Another point is that those tubes which are at the bottom of the drier and in contact with the material processed when the drier is set rotating become filled with condensate and fail to provide for a heat exchange as intensive as the upper tubes filled with steam but lacking contact with the material are capable of. The numerous holes the tube plates are pierced with to receive the ends of the tubes reduce the strength of the drier casing and for keeping this strength within a safe limit an increase in the thickness of drier casing is required, calling for high metal requirements.

The longitudinal arrangement of tubes relative to the drier casing prevents an effective mixing of the material processed therein, fails to provide for the equalization of its temperature at the walls and in the medial zone and is consequently incompatible with a sufficiently high performance of the heating surface per unit area. Longitudinally arranged tubes lift some of the material processed, turn it into dust which is carried away, inflicting losses of the product and blocking the system serving the purpose of evacuating the drier. Finally, the longitudinal arrangement of tubes referred to above makes the drier a bulky apparatus and creates no prospect of expanding the surface of heat exchange by a considerable amount no matter how intricate is its construction.

SUMMARY OF THE INVENTION

The main object of the present invention is to provide a drier for bulk material displaying a rate of throughput which is higher than in the known driers serving the samepurpose.

Another ojbect of the present invention, which is of no less importance than the above one, is to increase the surface of heat exchange by a considerable amount in the drier.

Yet another object of the present invention is to enhance the operational reliability of the drier and to extend the service life thereof.

An important object of the present invention is to reduce the metal requirements for the fabrication of the drier and to improve the quality of the end product obtainable through better mixing and uniform drying of the material processed.

Said and other objects are attained by providing a drier for bulk material, consisting of a hollow cylindrical casing with double walls forming a space for the passage of a heat carrier therethrough connected to a space inside each of tubular components disposed around the longitudinal axis of the case arranged at an angle to the horizontal axis of its rotation, wherein according to the invention an inlet manifold and an outlet one are attached each with only one of its ends inside a space formed by an internal wall of the casing so that the space, passing wherethrough is the heat carrier, is connected to the space inside each of the tubular components which are made in the form of coils each bent into a helix of suitable shape and located coaxially one with respect to another.

Tubular components of said shape and arrangement provide for a substantial increase in the surface of heat exchange and, as a consequence, add to the rate of throughput of the drier. In the tubular components provided in the form of coils each bent into a helix the thermal stresses are duly compensated and this eliminates the possibility of failures of welds at the points where the heat carrier is either admitted into or discharged from the tubular components. The coaxial arrangement of the coils expands the surface of contact between the heating surface and the material processed, intensifies the mixing thereof, ensures its uniform drying and, as a consequence, provides for the yield of a quality end product.

It is expedient that the points whereat the coils are connected to the manifolds are separated from the internal wall of the casing by a distance anywhere between $\frac{1}{3}$ and $\frac{1}{2}$ of the internal diameter of the casing of the drier. Said location of the points whereat the coils are connected to the manifolds permits to free the coils of condensate which flows therein along the helix when the casing of the drier is set to rotate, intensifying thereby the process of heat exchange.

DESCRIPTION OF THE DRAWINGS

The present invention will now be described by way of example of a drier for bulk material with reference to the accompanying drawings in which.

FIG. I is a sectional elevation of the drier according to the invention.

DETAILED DESCRIPTION OF THE INVENTION

Figure 2:
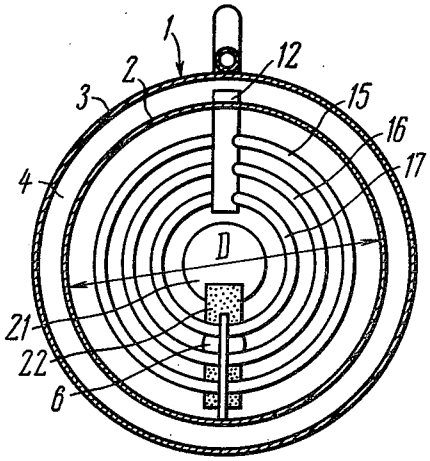
FIG. 2 is a section on line II—II of FIG. I.
Figure 1:
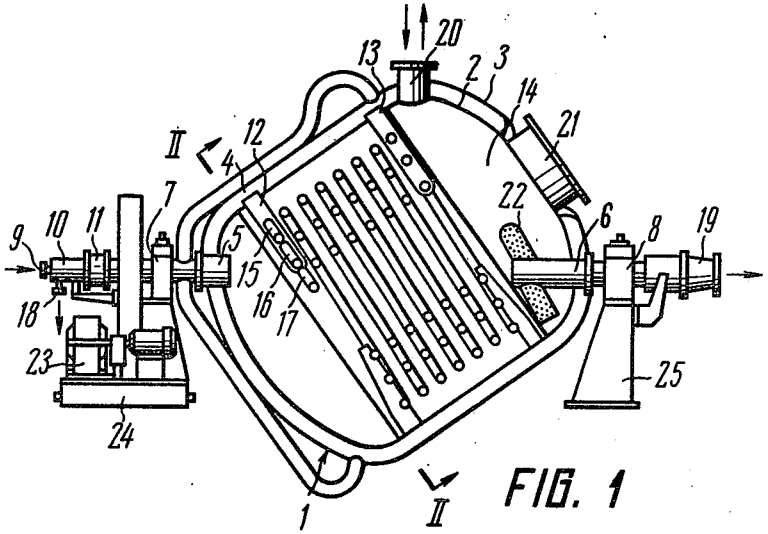

Referring to FIGS. 1 and 2, the drier consists of a hollow cylindrical casing I fabricated by welding with an internal wall 2 and an external one 3 forming a space 4 passed wherethrough is a heat carrier, e.g., steam. The casing I is arranged at an angle of 35 deg. to the horizontal axis of its rotation and is supported in bearings 7 and 8 by means of trunnions 5 and 6 (FIG. I). The heat carrier, i.e., steam, is admitted into the space 4 between the walls 2 and 3 of the case through passages (not shown) in a pipe 9, union 10, seal II and trunnion 5. The space 4 is connected to manifolds 12 and 13 attached each only with one of its ends to the internal wall 2 on the side of a space 14 in the casing I of the drier. Fitted with their ends to the manifolds 12 and 13 are three tubular components made in the form of coils 15, 16 and 17 each bent into a helix of suitable shape. The space inside each of said coils is connected to the manifolds 12 and 13, and the coils 15, 16 and 17 (FIG. 2) are located around the longitudinal axis of the casing I and coaxially relative to one another. The points whereat the coils 15, 16 and 17 are connected to the manifolds 12 and 13 (FIG. I) are separated from the internal wall 2 of the casing I by a distance anywhere between $\frac{1}{3}$ and $\frac{1}{2}$ of the internal diameter D (FIG. 2) of the casing I of the drier. Serving the purpose of draining the spaces inside the coils 15, 16 and 17 of condensate are passages (not shown) the outflow wherefrom is discharged through a pipe 18 (FIG. I) in the union 10 on the side of the trunnion 5. Another passage (not shown) in the trunnion 6 serves to discharge the mixture of air and vapour from the space 14 of the casing I of the drier into a union 19. The case I of the drier is provided with a port 20 through which the green bulky material is being loaded and the end product discharged. A manhole 21 in the case I is provided which gives access to the coils 15, 16, 17 and to filters 22 attached to the trunnion 6 for their servicing. Mounted on a frame 24 is a drive 23 imparting rotary motion to the drier, and the bearing 8 giving support to the trunnion 6 rests, in its turn, on a pedestal 25.

The drier operates on the following lines. A given batch of green bulk material is loaded into the drier through the port 20 when this is located in its topmost position. On finishing with the loading, the port is closed in an air-tight fashion, the casing I of the drier is set into rotation by means of the drive 23 and the space 14 inside the casing I is evacuated. A heat carrier, commonly steam, is admitted into the space 4 between the walls 2 and 3 of the casing I of the drier, and from said space it reaches each of the coils 15, 16 and 17 by way of the manifold 13. In the coils, the heat carrier cools down and a part thereof becomes condensed. The condensate so formed drips down the helices, being induced by the rotation of the coils, collects in the manifold 12 located lower than the manifold 13 and reaches the pipe 18 through the passages in the trunnion 5 and union 10. The green material loaded into the space 14 for drying spreads along the internal wall 2 of the casing I as this is set rotating and comes into contact with the outside surface of the coils 15, 16 and 17, warming up a good deal in consequence and intermixing with great vigour. This all results in an efficient drying of the material. The mixture of air and vapour formed in the course of drying is exhausted from the space 14 of the case I through the filters 22 and the passages in the trunnion 6 and the union 19.

The intensity of the process of drying is enhanced in the drier by employing a high-temperature and high-pressure heat carrier and by freeing the coils of condensate. These advantages have become a practical possibility due to improving the construction of the drier in accordance with the invention. The coils of the shape used in the drier provide for the flow of the material dried therebetween at right angles thereto, reducing the carry-over, i.e., the waste, of the end product and boosting the heat exchange by a considerable amount.

On finishing with the drying of bulk material, the drive 23 is stopped, the casing I turned so that the port 20 faces the floor, the system of evacuating the drier is disconnected, the port 20 is opened and the end product is discharged therethrough.

Tests have proven that the drier creates the prospect of increasing the temperature of heat carrier along with the mixing of the material treated in a more intensive way than ever before, improving the process of heat exchange, expanding the heating surface under the conditions of a compact arrangement of the coils, reducing metal requirements, making the drier amenable to streamlined production and reducing waste of the material treated by reducing the carry-over thereof with the stream of air and vapour exhausted from the drier. In addition, the rate of throughput of the drier has gone up, a two-fold increase in the surface of heat exchange being present, and the operational reliability of the drier has improved owing to the elimination of the destructive thermal stresses from the welds at the ends of the coils. There are good reasons to expect that the field of application of the drier will expand and its performance will further improve. The fact that the initial turn of each coil is connected to the manifold at a distance of at least $\frac{1}{3}$ of the internal diameter of the case of the drier enables complete draining of each coil of condensate and consequently provides for highly intensive performance thereof.

What is claimed is:

1. A drier for bulk material comprising a hollow cylindrical casing arranged at an angle to the horizontal axis of its rotation; double walls of said hollow cylindrical casing forming a space for the passage of a heat carrier; manifolds serving to admit and discharge the heat carrier, each being attached with only one of its ends inside a space formed by the internal wall of said hollow cylindrical casing; tubular components made in the form of coils each bent into a helix of suitable shape, coaxially located relative to one another around the longitudinal axis of the casing and connected with their ends to the respective said manifolds admitting the heat carrier thereinto and discharging same therefrom.

2. A drier as claimed in claim 1, wherein the points whereat said coils are connected to said manifolds are separated from the internal wall of said hollow cylindrical casing by a distance anywhere between $\frac{1}{3}$ and $\frac{1}{2}$ of the internal diameter of said case of the drier.

* * * * *